United States Patent [19]

Ernst et al.

[11] 4,403,705

[45] Sep. 13, 1983

[54] SHORT COUPLING FOR RAIL VEHICLES

[75] Inventors: Dieter Ernst; Hilmar Forster; Wilhelm Günther, all of Wolfenbüttel; Ernst Vahldiek, Beierstedt, all of Fed. Rep. of Germany

[73] Assignee: Scharfenbergkupplung GmbH, Fed. Rep. of Germany

[21] Appl. No.: 155,164

[22] Filed: Jun. 30, 1980

[30] Foreign Application Priority Data

Jun. 1, 1979 [DE] Fed. Rep. of Germany ..... 2922439

[51] Int. Cl.[3] ..... B61G 5/06

[52] U.S. Cl. ..... 213/1.3; 280/422; 307/9; 339/16 R

[58] Field of Search ..... 213/1.3, 1.6; 280/420, 280/421, 422; 339/15, 16 R, 16 C, 16 RC; 180/315, 78; 307/9, 10 R, 10 LS

[56] References Cited

U.S. PATENT DOCUMENTS

| | | | |
|---|---|---|---|
| 2,422,355 | 6/1947 | Knapp | 213/1.3 |
| 2,883,069 | 4/1959 | Candlin, Jr. et al. | 213/1.3 |
| 3,249,239 | 5/1966 | Herbert et al. | 213/1.6 |
| 4,284,311 | 8/1981 | Forster et al. | 213/1.3 |

FOREIGN PATENT DOCUMENTS

| | | | |
|---|---|---|---|
| 1780664 | 8/1973 | Fed. Rep. of Germany | 213/1.3 |
| 1335016 | 7/1963 | France | 280/421 |
| 8003173 | 12/1980 | Netherlands | 213/1.3 |
| 1006659 | 6/1965 | United Kingdom | 213/1.3 |
| 237190 | 4/1971 | U.S.S.R. | 213/1.3 |

*Primary Examiner*—Joseph F. Peters, Jr.
*Assistant Examiner*—Mitchell J. Hill
*Attorney, Agent, or Firm*—McGlew and Tuttle

[57] ABSTRACT

An improved arrangement of a short coupling for rail vehicles includes a pair of plates connected to the short coupling which supports an axially displaceable electrical line coupling as well as a pneumatic line coupling and a centering pin and bore for engaging complementary centering pins and bores of a counter-coupling.

4 Claims, 2 Drawing Figures

SHORT COUPLING FOR RAIL VEHICLES

FIELD AND BACKGROUND OF THE INVENTION

The invention relates to a short coupling for rail vehicles having both a centering pin and a bore for receiving the centering pin of a counter-coupling and with a support, offset relative to the short coupling, for axially displaceable electrical line couplings.

In known arrangements, the underside of the short coupling has a support, integrally fixed to the coupling by casting or welding, which receives the guide for the electric line couplings. From German Pat. No. 1,003,788, it is also known to arrange both a centering pin and a bore for the centering pin of a countercoupling, in the end face of the short coupling. Also, in central buffer couplings, arrangement of the pneumatic line coupling in the end face is generally known. These arrangements disadvantageously fix both the number and the position of the line couplings to be connected and make subsequent attachment or conversion of line couplings very difficult or impossible.

SUMMARY OF THE INVENTION

It is the object of the invention to set up an arrangement in a short coupling of the abovementioned kind whereby the subsequent attachment of line couplings and the expansion of the number of existing line couplings is possible.

According to the invention, this problem is solved in that a support for the pin and the bore consists of two similarly-formed plates which are mirror-symmetrical to a vertical median plane of the short coupling and are detachably connected and retained on the short couplings by horizontal screw bolts, the plates carrying the guide for the electrical as well as for the pneumatic line couplings and also the centering pins and bores for the centering pins of the counter-coupling.

Accordingly, it is an object of the invention to provide an improved arrangement of a short coupling for rail vehicles of the type having means for supporting an axially displaceable electrical line coupling, and both a centering pin and a bore for receiving the centering pin of a counter-coupling to be engaged therewith, the improvement in which the support means comprises a pair of plates, each of the plates being disposed in mirror symmetrical relationship relative to a vertical median plane extending through the short coupling, means for detachably connecting each of the plates to each other and to a short coupling, the centering pin of the short coupling being mounted on the support means and the support means including a bore for receiving the centering pin of the counter-coupling, and wherein the support means includes means for guiding the axially displaceable electrical line coupling and a pneumatic line coupling operatively connected to the support means.

It is a further object of the invention to provide an improved arrangement of a short coupling for vehicles which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
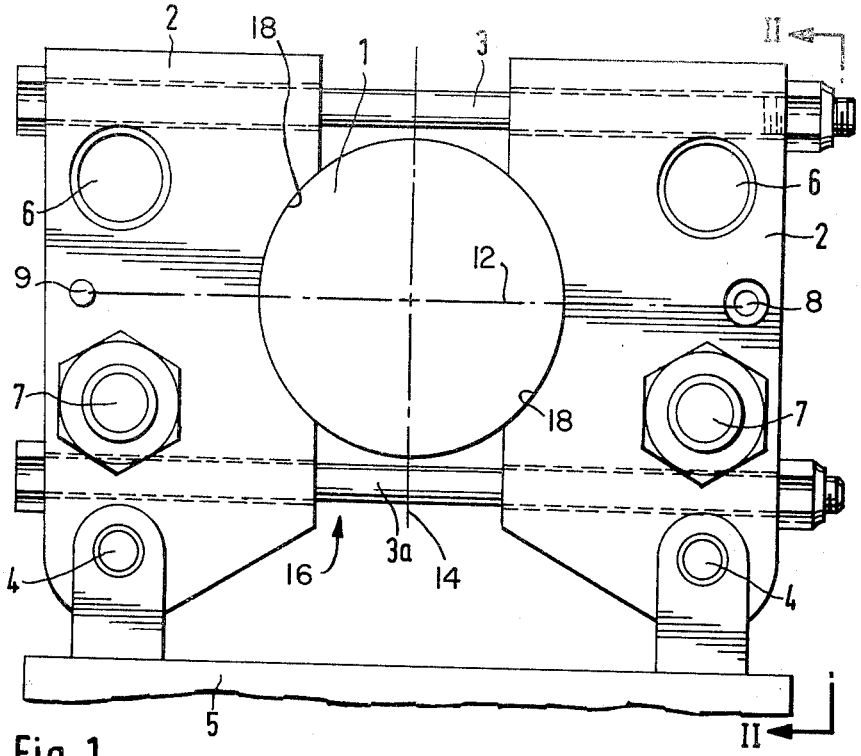
FIG. 1 schematically illustrates a short coupling in top view.

Referring now to the figures, in particular, which show a preferred embodiment of an improved arrangement of a short coupling for rail vehicles according to the invention, there is shown a pair of side plates 2 affixed against the short coupling 1 which is designed to be connected to a counter-coupling (not shown) in known manner by sockets (also not shown). The side plates 2 are disposed in mirror-symmetrical relationship on opposite sides of the vertical median plane 14 of the short coupling 1 with a gap 16 therebetween. The plates 2 are detachably connected, above and below the horizontally oriented short-coupling, by screw bolts 3 and 3*a*. In the embodiment shown, and below screw bolt 3*a*, each plate 2 has a guide 4 movably mounted thereon for mounting an axially displaceable electrical line coupling 5. Each plate 2 has a recessed bearing surface or face 18 which bears on short coupling 1 and has a contour matching that of the short coupling. Internally, that is, between the screw bolts 3, 3*a*, bores 6 are provided for receiving pneumatic line couplings 7. The plates 2 are alternately provided with a centering pin 8 and a bore 9 for receiving the centering pin of the counter-coupling (not shown). Pin 8 and bore 9 lie on the horizontal median plane 12 through the short coupling.

Figure 2:
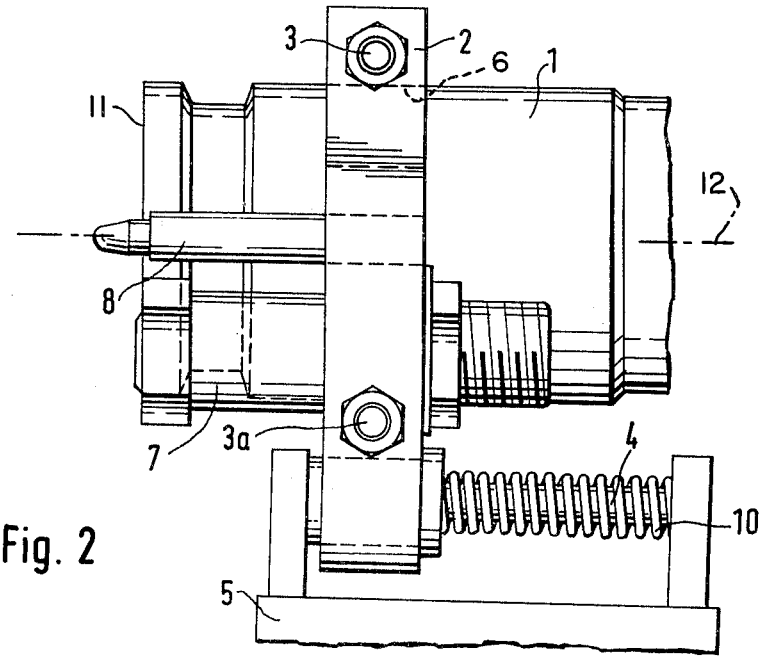
FIG. 2 is a view taken along line II—II of FIG. 1.

The short coupling 1 is connected to a short coupling of a counter-coupling (not shown) by sockets (also not shown). The plates 2 are offset rearwardly in relation to the end face 11 of the short coupling 1 and the centering pin 8 or the pneumatic line couplings 7 are in a forward position extending so far that they lie before or in the plane of the end face 11 of the short coupling. In contrast, the axially displaceable electrical line coupling 5, is held in the uncoupled position by a spring 10 that lies behind the end face. The electrical line coupling 5 is pushed forward against the bias of spring 10 (to the left of FIG. 2) only for coupling so as to obtain the necessary bearing pressure for the contacts (not shown).

We claim:

1. In an arrangement for a short coupling for rail vehicles, the short coupling having an end face and being of the type having guide means for supporting an axially displaceable electrical line coupling, and support means for both a centering pin and a bore for receiving the centering pin of a counter-coupling to be engaged therewith, and a bore for receiving a fixed pneumatic line coupling, the improvement in which said support means comprises two plates, each of said plates being shaped and disposed in mirror-symmetrical relationship relative to a vertical median plane extending through the short coupling, with a gap between said plates, said plates each having a recessed bearing face with a contour matching an outer contour of the short coupling, a screw bolt extending horizontally through said two plates above and below the short coupling and bridging said gap for detachably connecting each of said plates to each other and to the short coupling with each bearing face engaging the short coupling, said two plates offset axially rearwardly with respect to the end face, the centering pin of the short coupling being mounted on said support means and said support means including the bore for receiving the centering pin of a counter-coupling and for receiving the fixed pneumatic line coupling, and wherein said support means includes means for guiding the axially displaceable electrical line coupling.

2. In an arrangement according to claim 1, the improvement comprising one of said two plates carrying the bore for receiving the centering pin of a counter-coupling, the centering pin connected to and extending forwardly of the other of said two plates.

3. In an arrangement according to claim 2, the improvement including each of said two plates having a bore for receiving the fixed pneumatic line coupling, and a fixed pneumatic line coupling connected to and extending forwardly of each of said two plates.

4. In an arrangement according to claim 2, the improvement wherein said means for guiding the axially displaceable electrical line coupling comprises a guide rod extending horizontally through each of said two plates and adjacent a lower end of each of said two plates, each of said guide rods connected to the axially displaceable electrical line coupling and each of said guide rods axially displaceable in each of said two plates respectively, and a spring engaged between the electrical line coupling and each of said two plates for biasing the electrical line coupling rearwardly with respect to the short coupling end face.

* * * * *